United States Patent [19]

Johnson

[11] Patent Number: 4,725,199

[45] Date of Patent: Feb. 16, 1988

[54] SNAP RING CONSTRUCTION

[75] Inventor: Thomas G. Johnson, West Palm Beach, Fla.

[73] Assignee: United Technologies Corporation, Hartford, Conn.

[21] Appl. No.: 812,026

[22] Filed: Dec. 23, 1985

[51] Int. Cl.[4] ..... F04D 29/54

[52] U.S. Cl. ..... 415/189; 415/217

[58] Field of Search ..... 415/134, 138, 139, 189, 415/190, 191, 216–218, 136

[56] References Cited

U.S. PATENT DOCUMENTS

| | | | |
|---|---|---|---|
| 2,599,654 | 6/1952 | Musikant | 415/216 X |
| 2,609,176 | 9/1952 | Purvis | 415/138 |
| 2,766,963 | 10/1956 | Zimmerman | 415/218 |
| 3,992,126 | 11/1976 | Brown et al. | 415/217 X |

FOREIGN PATENT DOCUMENTS

| | | | |
|---|---|---|---|
| 490094 | 1/1953 | Canada | 415/218 |
| 52-68611 | 6/1977 | Japan | 415/189 |
| 765345 | 1/1957 | United Kingdom | 415/217 |

*Primary Examiner*—Robert E. Garrett
*Assistant Examiner*—Joseph M. Pitko
*Attorney, Agent, or Firm*—Norman Friedland

[57] ABSTRACT

The inner and outer diameter of the flange of a snap ring are oriented relative to each other and the adjacent cases to which it is attached serve to support the high pressure turbine vanes of a gas turbine engine to maintain concentricity between the turbine rotor and stator.

5 Claims, 3 Drawing Figures

SNAP RING CONSTRUCTION

The Government has rights in the invention pursuant to Contract No. F33657-84-C-2122 awarded by the Department of the Air Force.

TECHNICAL FIELD

This invention relates to gas turbine engines and particularly to a triple flange configuration that serves to support the high pressure turbine vanes and maintain concentricity between the rotor and stator of the high pressure turbine section.

BACKGROUND ART

The best way of understanding this invention is to consider the components it replaces. It is well known, as for example, that in the F-100 engine manufactured by Pratt & Whitney Aircraft of United Technologies Corporation, the assignee of this patent application, the high pressure turbine vane is partially supported by a snap ring that is in turn supported by the cooperating flanges between the forward diffuser case and the aft or turbine case. This is best illustrated in FIG. 1, the prior art, which shows the heretofore known triple snap flange configuration prior to being replaced by the present invention. As noted in FIG. 1, the flange 10 of the snap ring 12 is supported between flange 14 of the diffuser case 16, which is fore in relationship to the direction of flow of the gas path and flange 18 of the turbine case 19 which is aft relative to this direction of flow. The flanges (triple) are secured about the circumferences by a plurality of nuts and bolts generally indicated by reference numeral 20 (one being shown). Ring 12 partially supports the high pressure turbine vane 32 in a well-known manner. The annular shoulders 24 and 26 of the snap ring 12 upon assembly are closely secured or snapped into place to bear against the complementing shoulders 28 and 30 of the fore and aft cases 16 and 19, respectively. As noted the aft case 19 is conically shaped with the apex being at the flange 18. When the load (represented by Arrow A) incurred by the aerodynamic loading on the vane 32 by virtue of flow of the gas path is transmitted to the aft case 19, the aft case 19 tends to distort in a direction that tends to shape the case in a cylinder. Obviously, this stress on the member is in tension, which imparts a radial load (Arrow B) in the direction of the engine's centerline on shoulder 26. This has the tendency of lifting the shoulder 24 of ring 12 away from the shoulder 28 of the diffuser case 16. Because the diffuser case supports the bearing compartment and attendant bearings supporting the high pressure turbine shaft, and the high pressure turbine (not shown), this assembly has the tendency to move or distort relative to the engine centerline and become eccentric thereto. This, obviously, displaces the turbine, i.e. disks and blades, relative to the static structure which includes the outer air seals imposing a gap on one diameter and a rub on the opposite diameter. This condition obviously adversely impacts the performance of the engine.

DISCLOSURE OF INVENTION

The object of this invention is to provide means for maintaining the concentricity of the high pressure turbine relative to its stator.

A feature of this invention is to replace the snap ring structure by one that is configured with an inside diameter snap bearing against the aft case and the outside diameter snap bearing against the fore case so as to maintain the concentricity of the stator and rotor elements within the aft case.

A feature of this invention is to provide in a gas turbine engine with a case loaded in tension housing the high pressure turbine section structural supports mechanism that imparts similar loads on the adjacent case to maintain concentricity of the rotor and stator structure of the high pressure turbine.

Other features and advantages will become apparent from the specification and claims and from the accompanying drawings which illustrate an embodiment of the invention.

BEST MODE FOR CARRYING OUT THE INVENTION

Figure 2:
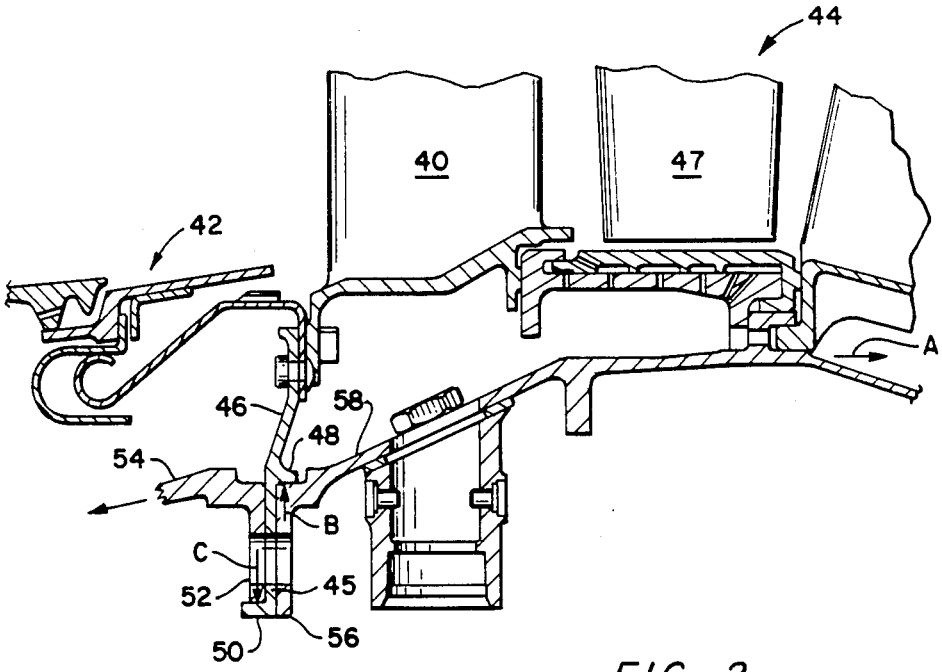
FIG. 2 is a fragmentary view similar to the structure in FIG. 1 showing the snap ring incorporating the invention.

As best seen in FIG. 2 the turbine stator vane 40 is supported between the combustor 42 and the turbine generally indicated by reference numeral 44 in a suitable manner. Only the portion of the turbine power plant that relates to the invention is described herein for the sake of simplicity and convenience. However, for further details of the power plant reference should be made to the engine such as the F-100 manufactured by Pratt & Whitney Aircraft of United Technologies Corporation, the assignee of this patent application, which is incorporated herein by reference.

Figure 1:
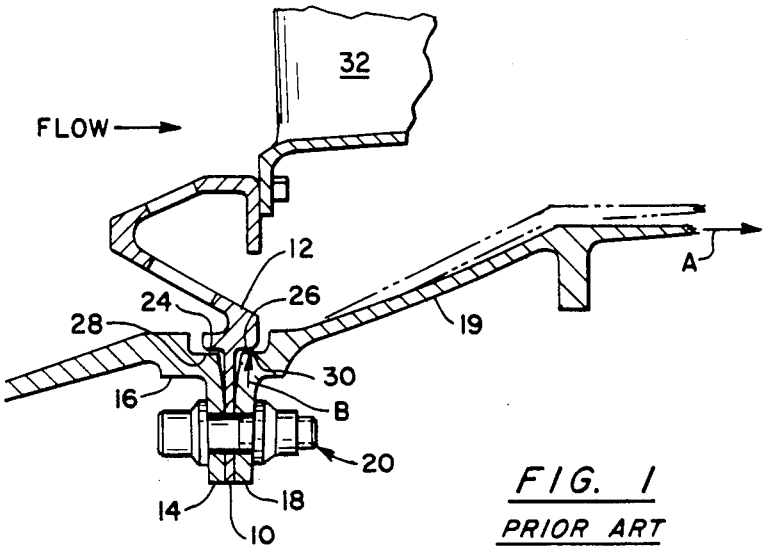
FIG. 1 PRIOR ART
FIG. 1 (prior art) is a fragmentary view in section showing the flange connection of the typical snap ring for a gas turbine engine.

Suffice it to say that the gases of combustion issuing from the combustor first pass through the stator vanes 40 and then impact upon the turbine blades 47 which extract the energy therefrom. The axial flow of the gas stream impacts a load on the vanes which was described in the prior art (FIG. 1) and will be described in further detail in connection with FIG. 3. As is apparent from FIG. 2 the heretofore snap ring 12 of FIG. 1 is replaced by the snap ring 46. According to this invention, the flange portion 45 of snap ring 46 carries a rearward projection 48 on the inside diameter defining an inner snap and a forward projection 50 in the outside diameter. As used in this context, the reference to forward and rearward are relative to the gas path of the power plant. Flange 45 is sandwiched between the flange 52 of diffuser case 54 and flange 56 of the aft case 58. The plurality of nut and bolt assemblies to the assembly shown in FIG. 1 serve to secure the triple flange. The load A as was described in FIG. 1 is reacted in the same manner as described above, but the reaction load on snap 50 shown by the vector Arrow C is substantially equal and opposite the load on snap 48 requested by vector Arrow B. This serves to assure that the shafts supported by the bearing will remain concentric and will prevent blade tip rub resulting in a consequential deterioration of the engine.

Figure 3:
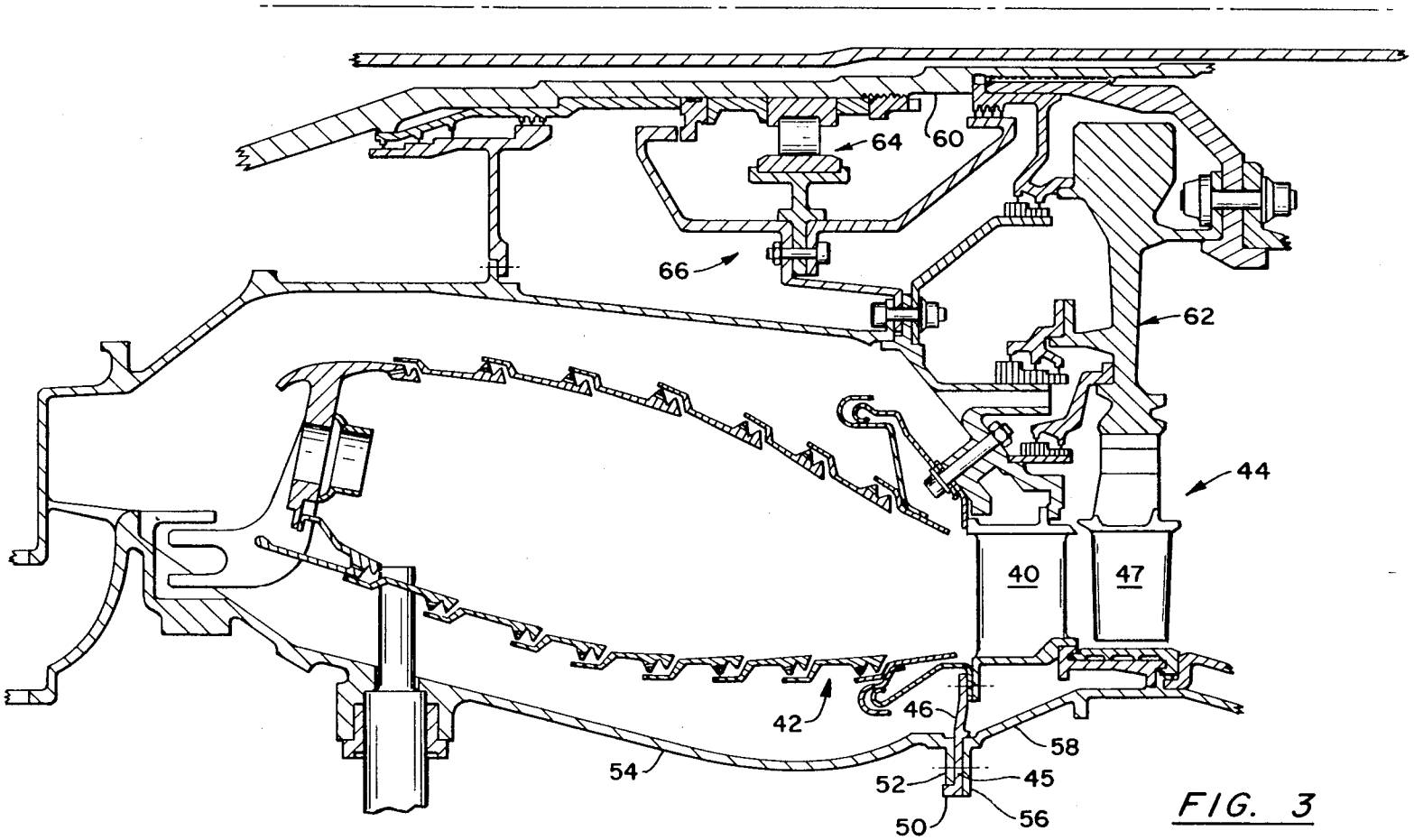
FIG. 3 is a partial view in section of the turbine and combustor section of a gas turbine engine employing the invention and illustrating the loads on the various components.

The efficacy of this invention can better be understood by referring to FIG. 3 which in a simplified schematic shows the shaft 60 supporting the turbine rotor 62 including the turbine blade 47 (like reference numerals refer to like parts in the accompanying drawings). The shaft 60 is supported by the main bearing 64 which in turn is suitably supported in the bearing compartment generally identified by reference numeral 66. The bearing compartment is attached to and supported by the diffuser casing 54 which in turn houses the burner 42. From the foregoing it is easy to appreciate that if the snap ring was distorted as in FIG. 1 (prior art) the shaft 60 would become displaced and move eccentrically relative to the stator portion adjacent the turbine and hence rubbing would occur. By virtue of this invention, the snap ring remains intact and counterbalances the loads to assure that the shaft 60 remains concentric.

It should be understood that the invention is not limited to the particular embodiments shown and described herein, but that various changes and modifications may be made without departing from the spirit and scope of this novel concept as defined by the following claims.

I claim:

1. For a gas turbine engine that includes a turbine section having a turbine rotor rotatably supported to a shaft and a stator section, a first flange adjacent a first case said case rotatably supporting said shaft, and a second flange adjacent a second case complementing said first flange to be secured together, a snap ring being generally Z-shaped in cross section having a third flange portion sandwiched between said first flange and said second flange to be secured therewith, one arm of said Z-shape defining a first snap portion bearing on the outer diameter of said third flange, and the opposing arm of said Z-shape defining a second snap portion bearing on the inner diameter of said third flange, said first snap portion and said second snap portion being in mating relationship in said first case and said second case and being oriented to prevent said first case from becoming unloaded so that said turbine rotor maintains its concentricity relative to said stator.

2. For a gas turbine engine as in claim 1 wherein said first case is a diffuser case and said second case is a turbine case.

3. For a gas turbine engine as in claim 2 wherein said first snap portion mates with said diffuser case and said second snap portion mates with said turbine case.

4. For a gas turbine engine as in claim 1 including a stator vane mounted ahead of said turbine rotor, and said stator vane being partially supported by said snap ring.

5. For a gas turbine engine as in claim 4 wherein the gas path flows from said stator vanes to said turbine rotor, and said first snap portion being oriented forward relative to the direction of flow of the gas path, and said second snap portion being oriented rearward relative to the direction of flow of said gas path.

* * * * *